US007102814B1

(12) United States Patent
Hughes

(10) Patent No.: US 7,102,814 B1
(45) Date of Patent: Sep. 5, 2006

(54) PERSONAL PORTABLE BLANKETS AS AN INFRARED SHIELDING DEVICE FOR FIELD ACTIVITIES

(75) Inventor: Robert Hughes, Lynn Haven, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 243 days.

(21) Appl. No.: 10/932,651

(22) Filed: Aug. 30, 2004

(51) Int. Cl.
*G06K 7/10* (2006.01)

(52) U.S. Cl. ..... 359/350; 89/36.02; 89/36.07; 250/504 R

(58) Field of Classification Search ..... 359/359, 359/360, 350; 250/339.14, 504 R, 515.1, 250/516.1; 89/36.02, 36.05, 36.07
See application file for complete search history.

(56) References Cited

U.S. PATENT DOCUMENTS 5,080,165 A * 1/1992 Engelhardt ..... 165/46

6,338,292 B1 * 1/2002 Reynolds et al. ..... 89/36.02

* cited by examiner

*Primary Examiner*—Leonidas Boutsikaris
(74) *Attorney, Agent, or Firm*—James T. Shephed

(57) ABSTRACT

A system shields IR emissions from remote sensors and has a flexible outer metallic layer extending to cover objects emitting IR energy on the covered ground. The outer layer is conductive of heat energy and faces upward. A flexible inner metallic layer coextensively extends adjacent to the outer metallic layer. The inner layer is conductive of heat energy and faces downward. Spaced-apart thermo electric chips are between and in contact with the outer and inner layers. The chips transfer heat energy between the outer and inner layers. A sensor of IR radiation on ambient ground provides signals representative of the thermal signature of the ambient ground. A controller couples signals to the chips in response to the representative ambient ground thermal signals for controlling the heat energy radiated from the outer layer to match the radiated IR signature from the outer layer to the IR signature of the ambient ground.

20 Claims, 3 Drawing Sheets

PERSONAL PORTABLE BLANKETS AS AN INFRARED SHIELDING DEVICE FOR FIELD ACTIVITIES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to systems for reducing detectability of personnel and equipment. More particularly, this invention relates to a blanket-like IR shielding system providing concealment of personnel and equipment in the field from infrared (IR) sensors.

Concealment of personnel and equipment from hostile observation often is essential during special warfare and reconnaissance activities and/or before making an effective coordinated strike. The task of concealment can be even more difficult with IR imaging equipment being more available in the field. IR imaging equipment can indirectly measure the thermal profile of objects by the emission of the infrared signature in their field of view. Every material has a set of properties consisting of absorbtivity, reflectivity, and emissivity of IR radiation. An object's display in an IR imaging device is dependent on the actual temperature of the object multiplied by the fourth power of the absolute temperature of the object.

Because of the nature of ground combat, combatants, along with their equipment, are readily observable by IR imaging equipment during night and day. This is due to the temperature discrepancies between the human body and its environment and the large thermal masses of metallic materials (guns, tanks, etc.) which change temperature very slowly relative to their environment.

Thus, in accordance with this inventive concept, a need has been recognized in the state of the art for an inexpensive, transportable system that can be used to shield downed pilots and/or troops and equipment in the field to prevent identification by IR sensors and to retain the elements of concealment and surprise.

OBJECTS AND SUMMARY OF THE INVENTION

An object of the invention is to provide a man-portable infrared shielding system for personnel and equipment.

Another object of the invention is to provide a man-portable infrared shielding system for combatants, special warfare teams and reconnaissance members requiring long periods of hidden activity.

Another object of the invention is to provide a man-portable infrared shielding system for personnel and equipment large enough to mask one or more individuals or provide an overhead shield for a group of entrenched individuals and their equipment.

Another object of the invention is to provide a man-portable infrared shielding system having a layered blanket having thermal cooling, insulation, and conductivity for personnel and equipment.

Another object of the invention is to provide a man-portable infrared shielding system having a layered blanket having a small exhaust fan attached to the inner layer to remove internal heat.

Another object of the invention is to provide a man-portable infrared shielding system having a layered blanket including an IR measuring device coupled to a battery operated programmable controller to determine the thermal signature of the ground by combining its emissivity and temperature.

Another object of the invention is to provide a man-portable infrared shielding system having a layered blanket using a series of essentially solid-state refrigeration devices known as thermo electric chips (TECs) for temperature regulation.

Another object of the invention is to provide a man-portable infrared shielding system having a layered blanket provided with thermal-grounding stakes driven into the ground and TECs pumping heat energy into the surrounding ground.

These and other objects of the invention will become more readily apparent from the ensuing specification when taken in conjunction with the appended claims.

Accordingly, the present invention is a system that shields IR emissions from remote sensors and has a flexible outer metallic layer extending to cover objects emitting IR energy on the covered ground. The outer layer is conductive of heat energy and faces upward. A flexible inner metallic layer coextensively extends adjacent to the outer metallic layer, and the inner layer is conductive of heat energy and faces downward. An insulating layer holds the outer and inner metalized layers in a virtually uniform spaced-apart relationship with respect to each other and a matrix pattern of transversely extending equal-distantly separated cavities extend through the insulation layer. Spaced-apart thermo electric chips are between and in contact with the outer and inner layers, and each of the cavities has a separate one of the thermo electric chips contained therein. The chips transfer heat energy between the outer and inner layers. A sensor of IR radiation on ambient ground provides signals representative of the thermal signature of the ambient ground. A controller couples signals to the chips in response to the representative ambient ground thermal signals for controlling the heat energy radiated from the outer layer to match the radiated IR signature from the outer layer to the IR signature of the ambient ground.

DESCRIPTION OF THE PREFERRED EMBODIMENTS

Figure 1:
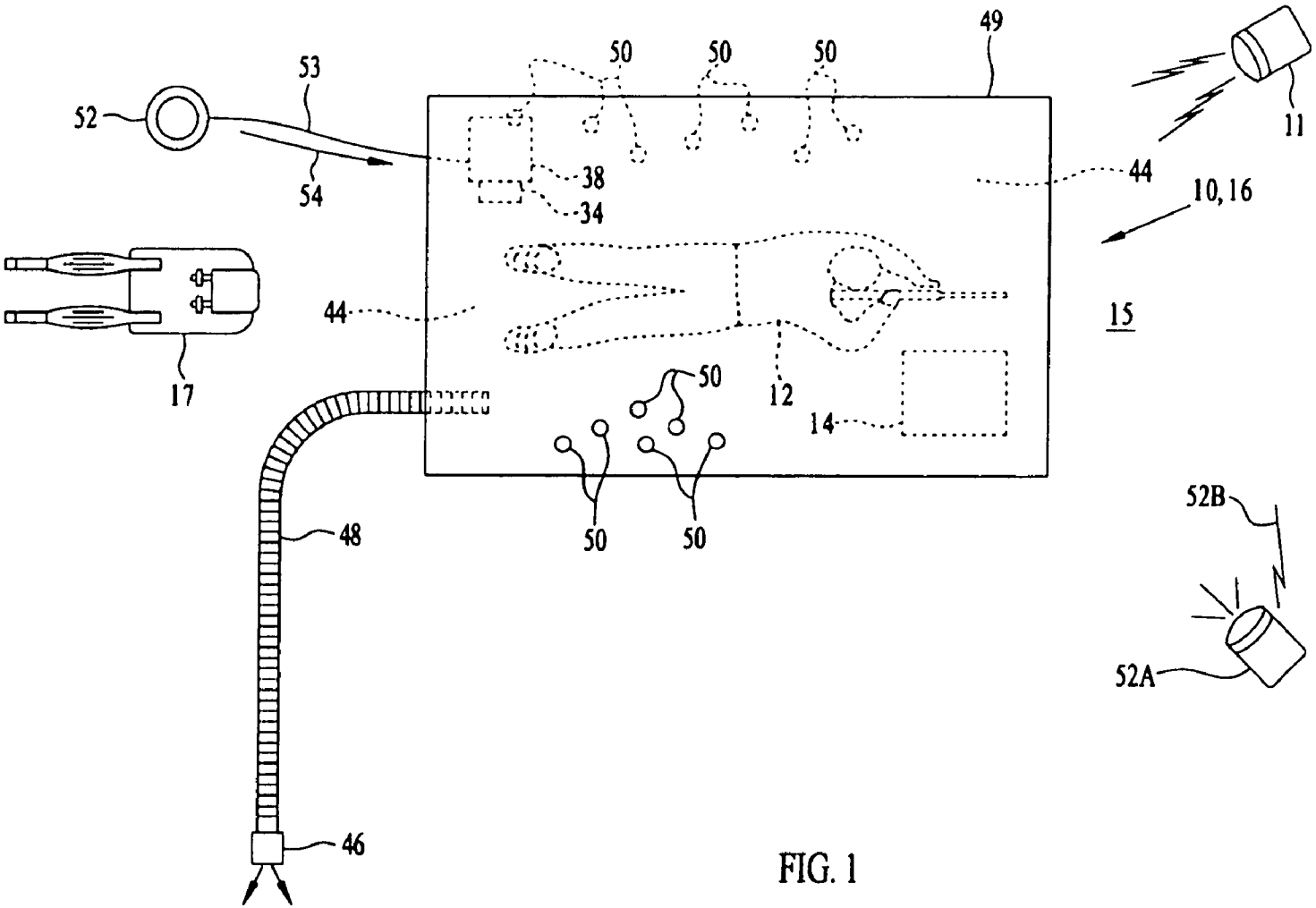
FIG. 1 is a schematic top view of the man-portable infrared shielding system of the invention covering and providing IR shielding for a combatant and equipment.

Referring to FIG. 1, a system 10 for shielding infrared (IR) emissions from objects from remote IR detection/imaging devices 11 is shown covering and providing IR shielding for IR emitting objects like a combatant 12 and equipment 14 on the ground 15. Shielding of IR emissions from such objects is essential for successful operations particularly in the field. IR detection devices 11 currently are capable of detecting personnel and equipment in the field both during the day and especially at night and develop images based on the IR emissivity and thermal gradients given off by these objects. These detection devices 11 are becoming cheaper to produce and are more powerful. Consequently, greater use of these IR technology devices is foreseen by potential adversaries to identify targets and conduct effective attacks, especially at night.

IR shielding system 10 of the invention counters the effectiveness of IR imaging equipment 11 that operates by sensing/using IR signatures. An IR signature consists of wavelengths of light that are not visible to the human eye but are produced by the IR emissivity of an object, multiplied by its absolute temperature to the fourth power. Objects, such as humans having a near constant body temperature that is usually different from their surrounding environment, and large objects such as tanks, transports, and other equipment which change temperature slowly compared to their environment, are readily visible in the IR spectrum. This is because of the contrast they have with respect to their background environments. This contrast holds true even while the objects are nearly invisible in the visible light spectrum by camouflage or a lack of light during dawn/dusk and nighttime.

IR shielding system 10 of the invention as described herein can be made compact enough to be portable by an individual combatant in the field and is readily deployed to provide concealment from IR detection. Shielding system 10 could weigh less than ten pounds and would be able to shield one or two individuals.

Infrared shielding system 10 can be fabricated as a multi-layered flexible blanket-like structure 16 that can be sized to be portable by an individual and carried into the field in a back pack 17. When an IR detection threat is perceived, multi-layered flexible blanket-like structure 16 of infrared shielding system 10 is taken from back pack 17, unfolded, and spread out to cover combatant 12 and supporting equipment 14 until the threat is no longer of concern. Infrared shielding system 10 can be refolded and returned to back pack 17 for reuse again later during the same mission or returned to a supply depot for reissue.

Figure 2:
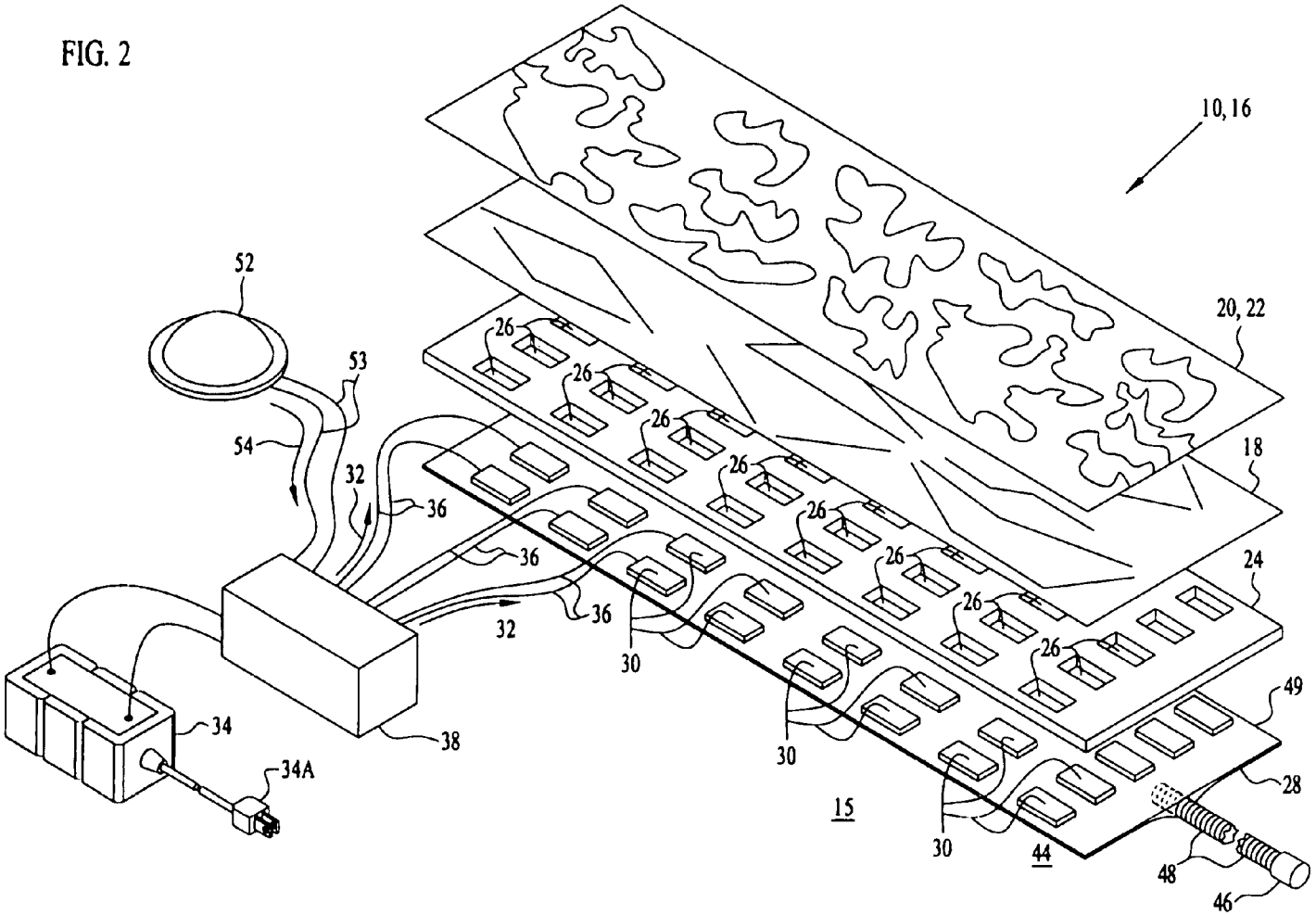
FIG. 2 is a isometric, schematic, exploded view of the man-portable infrared shielding system of the invention having a layered blanket structure operatively associated with sensor, computer controller and battery pack.

Referring also to FIG. 2, multi-layered flexible blanket-like structure 16 of infrared shielding system 10 has an outer flexible and highly conductive, thin metallic cover 18 transmissive of heat energy and facing upward toward the surrounding sky when deployed. Metallic cover 18 can be metal foil that is thick enough to transmit the required heat between chips. Metallic cover 18 can have an exposed printed, painted or otherwise textured coating 20 having a camouflaged pattern. Coating 20 might also be used in conjunction with a loose overlay 22 including selected strands, fabric and pieces that along with coating 20 attempts to conform to the anticipated ambient ground cover. Loose overlay 22 provides more complete optical deception with camouflaged pattern coating 20 as the outer and most visible layer of IR shielding system 10. Overlay 22 can clip-onto blanket 16 or other hidden area and can be changed as needed to maintain optical camouflage under changing conditions or to match different ambient conditions and environments.

An insulation layer 24 adjacent and attached to inside of outer metallic cover 18 has a matrix pattern of transversely extending cavities 26 extending through it. Cavities 26 can be equal-distantly separated from each another. Insulation layer 24 can be a flexible, thin, thermally-insulating plastic foam-like material bonded to outer metallic cover 18 and to an inner metallic layer 28 that coextends with outer metallic cover 18. Inner metallic layer 28 can be metal foil or a metalized sheet of lightweight, flexible, and tough plastic-like material transmissive of heat energy that faces downward toward ground 15 when deployed. Insulating layer 24 holds outer and inner metalized layers 18, 28 in a virtually uniform spaced-apart insulated relationship with respect to each other to prevent or isolate thermal contact between them. Inner metallic layer 28 is thicker than outer metallic layer 18, about 0.040 inches thickness for inner layer 28 as compared to about 0.020 inches for outer layer 18 for example, to account for an increased heat energy transfer by inner layer 28. The surface area of inner layer 28 can be increased to aid in the rejection of heat by such methods as corrugating it or otherwise folding it to increase its surface area.

Figure 3:
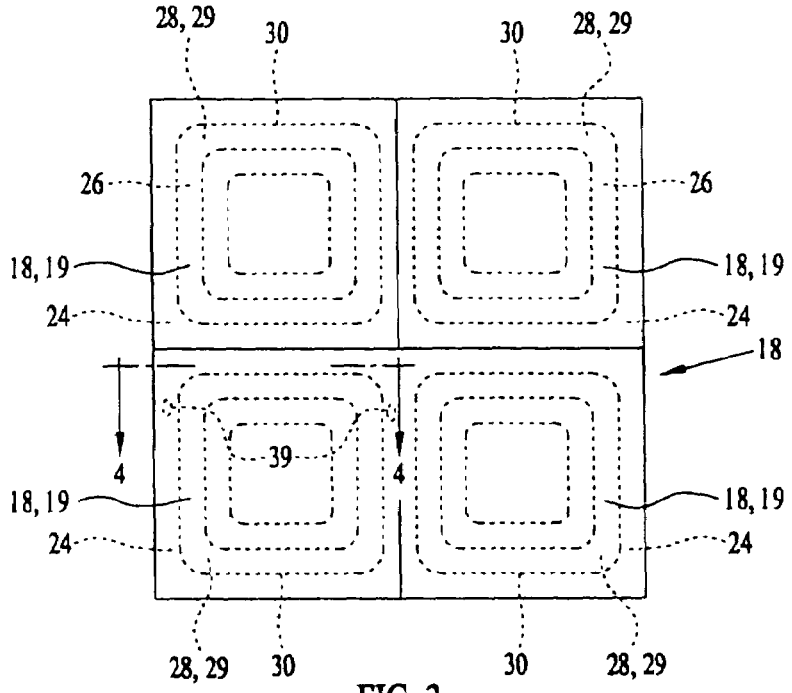
FIG. 3 depicts several TEC chips and one of their adjacent metallic layers of the layered shielding system of the invention.
Figure 4:
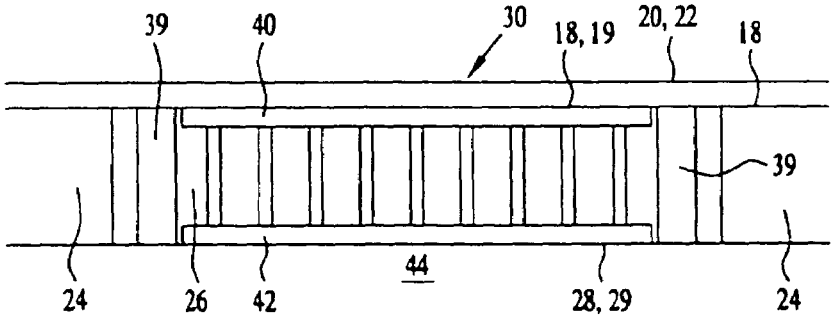
FIG. 4 is a cross-sectional side view of one of the TEC chips showing details of the layered structure taken along line 4—4 in FIG. 3.

Referring also to FIGS. 3 and 4, each cavity 26 of the matrix pattern in insulation layer 24 contains a thermo electric chip (TEC) 30. Thermo electric chips of the type used for TECs 30 are essentially solid-state refrigeration devices or Peltier elements well known in the art that rely on utilization of the Peltier Effect to create a cooling or heat transfer effect. The concentric square-shaped lines on an upper surface of each TEC 30 schematically represent control temperature gradients when each TEC 30 is changing temperature. These gradients will blend when a steady-state temperature for each TEC 30 is reached. This heating or cooling effect is created when a current (shown as arrow 32 in FIG. 2) of the proper magnitude and polarity is coupled to TECs 30 via leads 36 from a computer based controller 38. A battery pack 34 provides not only this current 32 for TECs 30, but additionally provides power to operate controller 38 and an emissivity (IR) sensor 52 connected to controller 38. The object of this feature of the design of infrared shielding system 10 is to make battery pack 34 run on only several D-cells for about twelve hours of autonomous protection for a combatant 12 and equipment 14. Battery pack 34 can have a multipurpose plug 34A that may include a converter for interconnection to an electrical power source that might be available at a deployment site to take advantage of this source of power.

Controller 38, battery pack 34 and sensor 52 can be made as an integrated compact unit in accordance with known integrated circuit fabrication procedures. A small enough package can be made for mounting adjacent to inner metallic layer 28 and not interfering with rolled/folded storage of system 10 or its later use as IR shielding.

Current 32 coupled to TECs 30 can create a cool junction at an outer plate section 40 of each TEC 30 and a hot junction at an inner plate section 42 at the opposite end of each TEC 30. The cool junction of outer plate section 40 of each TEC 30 is cooler with respect to each hot junction of each inner plate section 42 of each TEC 30. A further advantage of using TECs 30 is that they can optionally heat or cool metallic layers 18, 28 simply by reversing their current flow so that outer layer 18 (and inner layer 28) can either be heated or cooled as needed to accommodate different tactical scenarios. In other words, the direction of the transfer of heat between inner and outer plate sections 42, 40 in each TEC 30 can be reversed or be bidirectionally changed by reversing the polarity of a predetermined amount of current 32 from controller 38. The inner layer is larger to dissipate or conduct heat from the outside in, corresponding to cooling the outer layer 18 to environmental conditions and heating the user. A typical thermo electric chip that could be used for each of the TECs 30 of multilayered flexible blanket-like structure 16 of infrared shielding system 10 is the model UT4-12-30-f2 of the UltraTEC™ series commercially available by Melcor Inc., 1040 Spruce St., Trenton, N.J., 08648. Other models could be used as well depending on operational parameters.

Multi-layered flexible blanket-like structure 16 of infrared shielding system 10 has cavities 26 of insulating layer 24 positioning a cool junction of an outer plate section 40 of each contained TEC 30 adjacent to and in contact with an associated heat conductive area 19 of outer metallic cover 18 to selectively, bidirectionally transfer heat to or from outer metallic cover 18. Each cavity 26 also positions a hot junction of an inner hot plate section 42 of each TEC 30 adjacent and in contact with an associated heat conductive area 29 of inner metallic layer 28 to selectively, bidirectionally transfer heat to or from each TEC 30 to inner metallic layer 28. The TECs 30 are attached to outer and inner layers 18, 28 so that inner metallic layer 28 can conduct the heat from TECs 30 to a volume of air 44 under multi-layered flexible blanket-like structure 16. The size of conductive areas 19 and 29 and the TECs 30 selected are such as to minimize control time, energy and IR signature differences by TECs 30 across metallic outer layer 18 and inner metallic layer 28.

Multi-layered flexible blanket-like structure 16 of infrared shielding system 10 can have a small exhaust fan 46 attached via a flexible duct 48 to inner metallic layer 28. The IR shielded individual 12 under multi-layered flexible blanket-like structure 16 inside of air volume 44 can activate fan 46 to remove internal heat that may have built up. Duct 48 can be arranged to dissipate exhausted built-up heat from interior volume 44 under branches or other debris that may be piled around infrared shielding system 10 to reduce the possibility of creating an unwanted IR signature. The vented out heated air can be replaced by cool ambient air drawn in around the periphery 49 of blanket structure 16 into air volume 44, or the air flow of fan 46 can be reversed to draw in cool ambient air through duct 48, and the heated air inside of air volume 44 could be evenly dissipated from under the layered blanket structure 16 around its periphery 49.

Thermal grounding stakes 50 (only a few of which are shown) could be driven into ground 15 and placed in contact with inner plate sections 42 of at least some of TECs 30. Stakes, or heat pipes 50, could help dissipate some unwanted infrared-signature energy into ground 15 under blanket 16 and help absorb spikes of heat by system 10.

Computer-based controller 38 is connected via an optional internal power converter to battery pack 34 to give infrared shielding system 10 the capability for independent IR shielding in the field for prolonged periods of time. At least one ambient IR measuring sensing device 52 is laid on adjacent ambient ground 15 to determine the ambient ground thermal signature of ground 15 by combining data representative of the ground's IR emissivity and temperature. Representative signals (shown by arrow 54) of the ambient ground thermal signature are fed via lead 53 to controller 38 that is preprogrammed to determine the appropriate temperature for metallic outside layer 18 of blanket structure 16 that will match the IR signature of the surrounding ground 15. Reduced cost might result in placing an IR imaging item, such as an imager 52A, away from but pointed at blanket 16 to help control the signature, see FIG. 1. Wire leads or small RF communication devices for RF signal transmission 52B can be used to hide this extra part of IR imager 52A along with optical camouflage.

Control of TECs 30 of system 10 is done by appropriately preprogramming controller 38 and its interconnected battery pack 34. Controller 38 appropriately adjusts the magnitude (and polarity) of current 32 (voltages) connected to TECs 30 to create appropriate levels of cooling or heating power by TECs 30 that are coupled to outer metallic layer 18. These levels of cooling or heating power appropriately adjust the IR signature of infrared shielding system 10 to match that of surrounding or ambient ground 15. Temperature sensors 39 such as thermisters, only two of which are schematically shown in FIGS. 3 and 4, can be placed at predetermined locations between layers 18 and 28 in blanket 16 between TEC chips 30 to provide feedback over leads, not shown, to controller 38. With associated sensors such as thermisters 39 and IR sensor 52A for example, system 10 can react to have fully operable TECs 30 around inoperable TECs 30 compensate for failure of the inoperable chips. Since outside metallic layer 18 has a low thermal mass, its temperature can be rapidly adjusted to match temperature changes due to weather and time change and accordingly match as nearly as possible the IR signature of surrounding ground 15. Even if the IR signature of the surroundings is not matched perfectly, a possible target's IR profile can be at least broken up to make detection more difficult. Very little energy is required to achieve these changes, and several D-cells in battery pack 14 can do the job for hours.

Having the teachings of this invention in mind, modifications and alternate embodiments of infrared shielding system 10 may be adapted without departing from the scope of the invention. Its uncomplicated, compact design that incorporates structures long proven to operate successfully lends itself to numerous modifications to permit its reliable use under the hostile and demanding conditions routinely encountered during combat in the field. Infrared shielding system 10 can be fabricated in different physical arrangements from a wide variety of materials that have sufficient strengths and conductivities to provide long term reliable IR shielding under a multitude of different operational conditions. Infrared shielding system 10 of the invention can be modified within the scope of this inventive concept to provide an overhead shield for a group of individuals that are entrenched for example, and could be formed as larger infrared shields for critical field structures, such as ammunition and refueling dumps, and armored or support vehicles. In addition, controller 38 could be preprogrammed to cause blanket 16 to radiate signatures having the form of features naturally found in nature, such as rocks, stumps, fallen trees, etc. to further make detection difficult.

The disclosed components and their arrangements as disclosed herein, all contribute to the novel features of this invention. Infrared shielding system 10 provides a reliable and capable means of assuring IR concealment from hostile IR sensors to safeguard personnel and equipment from possible adverse consequences that could follow from otherwise being discovered. Therefore, infrared shielding system 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A system for shielding IR emissions from remote sensors comprising:

a flexible outer metallic layer extending to cover objects emitting IR energy on ground covered thereby, said outer metallic layer being conductive of heat energy and facing in an upward direction toward the sky;

a flexible inner metallic layer coextensively extending adjacent to said outer metallic layer, said inner metallic layer being conductive of heat energy and facing in a downward direction toward said covered ground;

a plurality of spaced-apart thermo electric chips between and in contact with said outer metallic layer and said inner metallic layer, said thermo electric chips transferring heat energy between said outer metallic layer and said inner metallic layer;

a sensor of IR emissivity and temperature on ambient ground for providing signals representative of the thermal signature of said ambient ground; and a controller coupling signals to said thermo electric chips in response to said representative ambient ground thermal signals for controlling the heat energy radiated from said outer metallic layer.

2. The system of claim 1 wherein said signals from said controller are fed to interconnected thermo electric chips to match the radiated IR signature from said outer metallic layer to the IR signature of said ambient ground.

3. The system of claim 2 further comprising:

an insulating layer holding said outer and inner metalized layers in a virtually uniform spaced-apart relationship with respect to each other.

4. The system of claim 3 further including;

a matrix pattern of cavities transversely extending through said insulation layer, said cavities being equal-distantly separated from each another and each of said cavities having a separate one of said thermo electric chips contained therein.

5. The system of claim 4 wherein each of said thermo electric chips includes an outer plate section and each of said cavities of said insulating layer positions a cool junction of each outer plate section of each thermo electric chip adjacent to and in contact with an associated heat conductive area of said outer metallic cover to transfer heat from said outer metallic cover.

6. The system of claim 5 wherein each of said thermo electric chips also includes an inner plate section and each of said cavities of said insulating layer positions a hot junction of each inner plate section of each thermo electric chip adjacent to and in contact with an associated heat conductive area of said inner metallic cover to transfer heat from each thermo electric chip to said inner metallic cover.

7. The system of claim 6 wherein the transfer of heat between said inner and outer plate sections in each thermo electric chip can be reversed in direction between them by reversing the polarity of said signals from said controller.

8. The system of claim 7 further comprising:

a battery pack connected to said controller for providing hours of autonomous IR protection for a combatant and equipment.

9. The system of claim 8 further comprising:

a coating of camouflaged pattern on said upwardly facing outer metallic layer; and a loose overlay of selected strands, fabric and pieces on said camouflaged pattern coating, said camouflaged pattern coating and said loose overlay conforming to ambient ground cover.

10. The system of claim 9 further comprising:

an exhaust fan and interconnected flexible duct connected to said inner metallic layer to remove internal heat from an interior volume under said inner metallic layer.

11. The system of claim 10 further comprising:

thermal grounding stakes driven into said covered ground and placed in contact with said inner plate sections of at least some of said thermo electric chips to help dissipate some unwanted infrared signature energy into said covered ground.

12. The system of claim 11 wherein said coating, said flexible inner metallic layer, said flexible outer metallic layer, said insulating layer, and said thermo electric chips in said insulating layer form a multilayered blanket structure.

13. The system of claim 12 wherein said battery pack has a multipurpose plug for connection to a source of power, and said overlay is detachable to permit replacement for changing ambient conditions.

14. A multilayered flexible blanket-like structure shielding IR emissions from remote sensors comprising:

means for providing a flexible outer metallic layer extending to cover objects emitting IR energy on ground covered thereby, said outer metallic layer providing means being conductive of heat energy and facing upward;

means for placing a flexible inner metallic layer coextensively extending adjacent to said outer metallic layer providing means, said inner metallic layer placing means being conductive of heat energy and facing toward said covered ground;

means disposing a plurality of spaced-apart thermo electric chips between and in contact with said outer metallic layer providing means and said inner metallic layer placing means, said thermo electric chips disposing means transferring heat energy between said outer metallic layer providing means and said inner metallic layer placing means;

means for sensing IR emissivity and temperature on ambient ground to provide signals representative of the thermal signature of said ambient ground; and means for creating controlling signals connected to said thermo electric chips disposing means in response to said representative ambient ground thermal signals for controlling the heat energy radiated from said outer metallic layer providing means.

15. The structure of claim 14 wherein said signals from said controlling signals creating means are fed to interconnected thermo electric chips to match the radiated IR signature from said outer metallic layer to the IR signature of said ambient ground.

16. The structure of claim 15 further comprising:

means for holding said outer metallic layer providing means and said inner metallic layer providing means in a virtually uniform spaced-apart insulated relationship with respect to each other.

17. The structure of claim 16 further including:

means for transversely extending a matrix pattern of cavities through said insulated holding means, said cavities being equal-distantly separated from each another and each of said cavities having a separate one of said thermo electric chips disposing means contained therein.

18. The structure of claim 17 wherein each of said thermo electric chips disposing means has an inner and outer plate section in contact with said inner metallic layer placing means and said outer metallic layer providing means, respectively, and the transfer of heat between said inner and outer plate sections in each of said thermo electric chips disposing means can be reversed in direction between them by reversing the polarity of said signals from said controlling signals creating means.

19. A method of shielding IR emissions from remote sensors comprising the steps of:

extending a flexible outer metallic layer to cover objects emitting IR energy on ground covered thereby, said outer metallic layer being conductive of heat energy and facing in an upward direction toward the sky;

coextensively extending a flexible inner metallic layer adjacent to said outer metallic layer, said inner metallic layer being conductive of heat energy and facing in a downward direction toward said covered ground;

placing a plurality of spaced-apart thermo electric chips between and in contact with said outer metallic layer and said inner metallic layer, said thermo electric chips transferring heat energy between said outer metallic layer and said inner metallic layer;

sensing IR emissivity and temperature on ambient ground to provide signals representative of the thermal signature of said ambient ground; and coupling signals from a controller to said thermo electric chips in response to said representative ambient ground thermal signals for controlling the heat energy radiated from said outer metallic layer.

20. The method of claim 19 further comprising the steps of:

holding said outer and inner metalized layers in a virtually uniform spaced-apart relationship with respect to each other by an insulating layer; and extending a matrix pattern of transversely extending cavities through said insulation layer, said cavities being equal-distantly separated from each other and each of said cavities having a separate one of said thermo electric chips contained therein.

* * * * *